US006070521A

United States Patent [19]

Otoshi

[11] Patent Number: 6,070,521

[45] Date of Patent: Jun. 6, 2000

[54] SLIDE CONTROL DEVICE OF PRESS

[75] Inventor: Yoshihiro Otoshi, Aichi-ken, Japan

[73] Assignee: Yamada Dobby Co., Ltd., Bisai, Japan

[21] Appl. No.: 09/173,564

[22] Filed: Oct. 16, 1998

[30] Foreign Application Priority Data

Mar. 16, 1998 [JP] Japan ..... 10-065819
Jun. 23, 1998 [JP] Japan ..... 10-175995

[51] Int. Cl.[7] ..... B30B 1/42; B30B 15/14

[52] U.S. Cl. ..... 100/48; 72/21.3; 72/430; 83/62.1; 83/74; 83/627; 100/99; 100/280

[58] Field of Search ..... 100/43, 48, 99, 100/214, 280; 72/21.3, 430; 83/62.1, 74, 627

[56] References Cited

U.S. PATENT DOCUMENTS

| | | | |
|---|---|---|---|
| 4,429,627 | 2/1984 | Edsö . | |
| 4,453,421 | 6/1984 | Umano | 100/99 |
| 4,480,538 | 11/1984 | Yoshida | 100/48 |
| 4,633,720 | 1/1987 | Dybel et al. | 100/99 |
| 4,979,401 | 12/1990 | Maeda | 100/99 |
| 5,138,217 | 8/1992 | Wada et al. | 310/323.21 |
| 5,197,186 | 3/1993 | Strong et al. | 72/430 |
| 5,279,197 | 1/1994 | Takeda et al. . | |
| 5,303,641 | 4/1994 | Gallandere | 100/43 |
| 5,379,688 | 1/1995 | Ishii | 100/43 |
| 5,483,874 | 1/1996 | Shimizu et al. | 100/50 |
| 5,502,996 | 4/1996 | Strong et al. | 72/430 |
| 5,669,257 | 9/1997 | Inoue et al. | 72/20.1 |
| 5,701,811 | 12/1997 | Kawakami | 100/99 |
| 5,813,274 | 9/1998 | Strong et al. | 72/430 |
| 5,813,322 | 9/1998 | Kuroda | 100/43 |
| 5,829,347 | 11/1998 | Hiruma | 100/43 |
| 5,887,469 | 3/1999 | Maeda et al. | 72/21.3 |

FOREIGN PATENT DOCUMENTS

| | | |
|---|---|---|
| 0 569 603 A1 | 11/1993 | European Pat. Off. . |
| 2 247 344 | 5/1975 | France . |
| 195 48 439 A1 | 7/1996 | Germany . |
| 59-110500 | 6/1984 | Japan . |
| 59-153600 | 9/1984 | Japan . |
| 62-64500 | 3/1987 | Japan . |
| 1-299798 | 12/1989 | Japan . |
| 10-202397 | 8/1998 | Japan . |
| 1195694 | 6/1970 | United Kingdom . |

OTHER PUBLICATIONS

International Publication No. WO96/23653, published Aug. 8. 1996.

Patents abstracts of Japan, vol. 012, No. 455 (M–767), Nov. 22, 1988 and JP 63 178000A, Jul. 22, 1988.

*Primary Examiner*—Stephen F. Gerrity

*Attorney, Agent, or Firm*—Nikaido, Marmelstein, Murray & Oram LLP

[57] ABSTRACT

Learning control is adopted in slide control of a press, and the actual behavior pattern of the slide is converged to the optimum pattern thereby breakage of a metal mold or the like can be prevented. The slide control device is provided with a linear motor or a servo motor driving the slide in reciprocation, a position detector detecting position of the slide, and a control circuit fixing and storing previously the command value of the optimum pattern of behavior of the slide, and calculating error between the real position data from the position detector and the fixed command value of the optimum pattern in a prescribed period of time from the drive start of the slide, and correcting the command value to be outputted in order to eliminate the error and outputting the command value after the correction and controlling the linear motor or the servo motor.

10 Claims, 8 Drawing Sheets

SLIDE CONTROL DEVICE OF PRESS

BACKGROUND OF THE INVENTION (1) Field of the Invention

The present invention relates to a slide control device of a press, more specifically to a slide control device controlling behavior of a slide of a press with good accuracy.

(2) Description of the Prior Art

In recent years, in presses, development of a linear motor press which is quite different from conventional mechanical presses such as a crank press, a link press or the like in a drive mechanism of a slide and drives a slide in reciprocation utilizing a linear motor has been advanced.

The inventors of the present invention have performed various sorts of tests using a trial machine of a linear motor press. As a result, when a linear motor is controlled by command value in response to the optimum pattern of behavior of a slide, it has been found that deflection or overshoot is generated in the actual behavior pattern particularly during the punching machining, and the metal mold may be broken due to the overshoot from the lower dead point of the slide.

Also a servo motor press is known where a servo motor is assembled in a press and a slide is driven. Also in this servo motor press, it has been found that a problem similar to that of the linear motor press exists.

SUMMARY OF THE INVENTION

In view of the above-mentioned problems in the prior art, an object of the present invention is in that learning control is adopted in a slide control of a linear motor press and a servo motor press, and the actual behavior pattern of the slide is converged to the optimum pattern thereby breakage of a metal mold is prevented. Further after the learning control, generation of machining error is detected, and improvement of the yield, prevention of the breakage of the metal mold or the like is intended.

DESCRIPTION OF THE PREFERRED EMBODIMENTS

An embodiment of the present invention will be described based on the accompanying drawings as follows.

Figure 1:
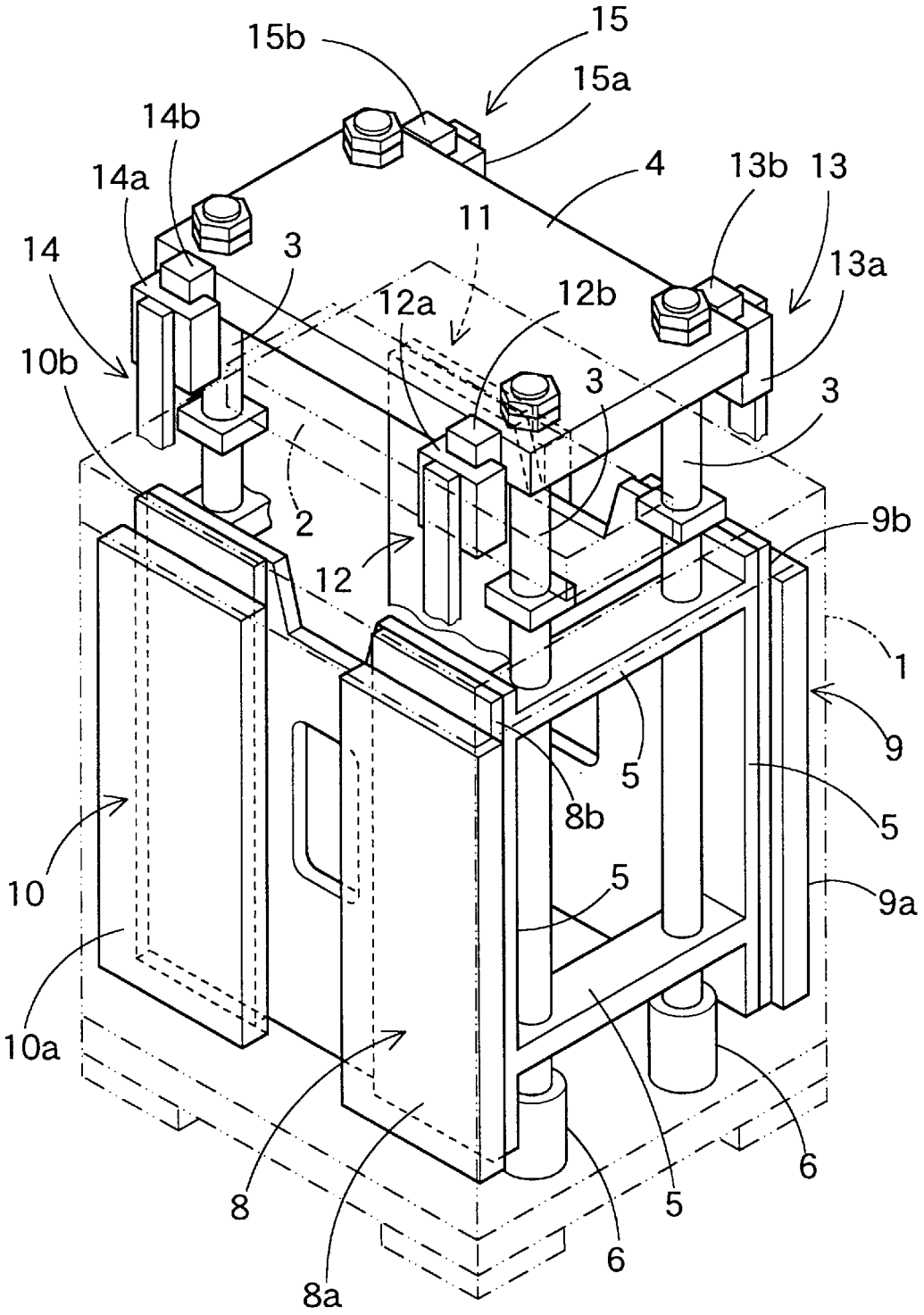
FIG. 1 is a perspective view of a linear motor press to which a slide control device according to an embodiment of the invention is applied.
Figure 2:
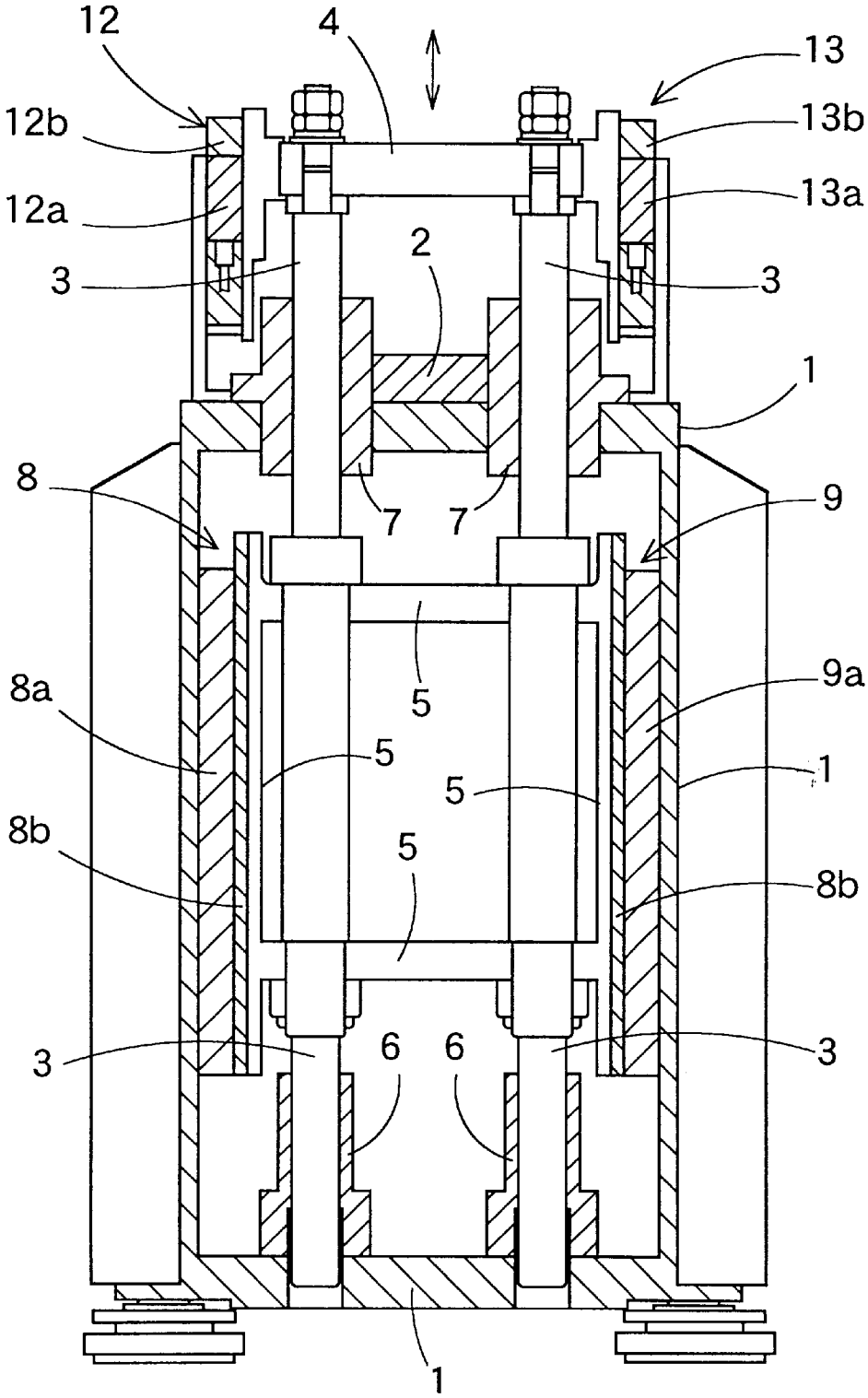
FIG. 2 is a longitudinal sectional view of the linear motor press.
Figure 3:
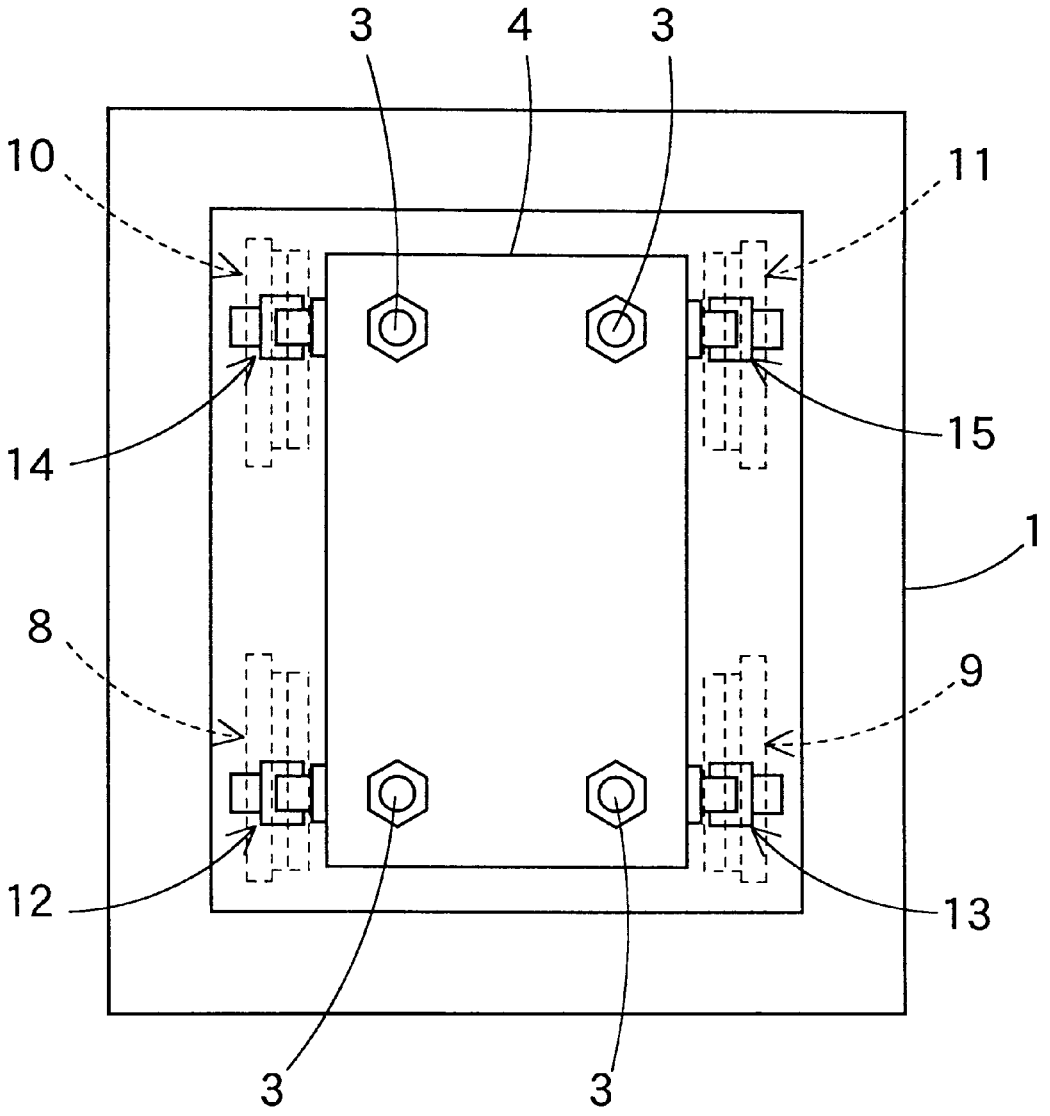
FIG. 3 is a plan view of the linear motor press.

In FIGS. 1–3, numeral 1 designates a body frame of a linear motor press. Four thrust bearings 6 are provided at the inner bottom side of the body frame 1 and further four thrust bearings 7 are provided also at the upper side of the body frame 1, and four guide posts 3 are supported movable up and down at the thrust bearings 6,7. Each of the four guide posts 3 is fixed to a frame 5 movable up and down within the body frame 1.

A bolster 2 is fixed on the upper side of the body frame 1, and a slide 4 is fixed horizontally to the top end of the four guide posts 3 projecting upward from the body frame 1 and the bolster 2. Within the body frame 1, four linear motors 8–11 are arranged so that the vertical movable frame 5, the guide posts 3 and the slide 4 are driven and moved up and down. In similar manner to that of a usual press, a lower mold (not shown) is fixed on the bolster 2, and an upper mold is fixed on the lower surface of the slide 4.

Each of the four linear motors 8–11 is arranged in the longitudinal direction to the lateral side of the vertical movable frame 5 at the inside of the body frame 1, and coil slides (stators in this embodiment) 8*a*–11*a* of the linear motors 8–11 are fixed to the side of the body frame 1, and magnet plates (travelers in this embodiment) 8*b*–11*b* of the linear motors 8–11 are fixed to the side of the vertical movable frame 5. Further corresponding to the linear motors 8–11, four linear scales (position detectors) 12–15 are arranged in the vicinity of the guide posts 3 at the lateral side of the slide 4. Stators 12*a*–15*a* of the linear scales 12–15 are mounted on the upper side of the body frame 1 through a bracket, and travelers 12*b*–15*b* of the linear scales 12–15 are mounted in the vicinity of the guide posts 3 at the lateral side of the slide 4. In the linear scales 12–15, for example, that of absolute type is used, and the position data in the absolute type are outputted.

In the linear motor press in such structure, due to the reciprocation motion of the linear motors 8–11, the vertical movable frame 5, the guide posts 3 and the slide 4 as one body are moved up and down by controlled velocity and stroke, and based on the data of the moving position outputted from the linear scales 12–15, the moving of the slide 4 is controlled at high accuracy.

Figure 4:
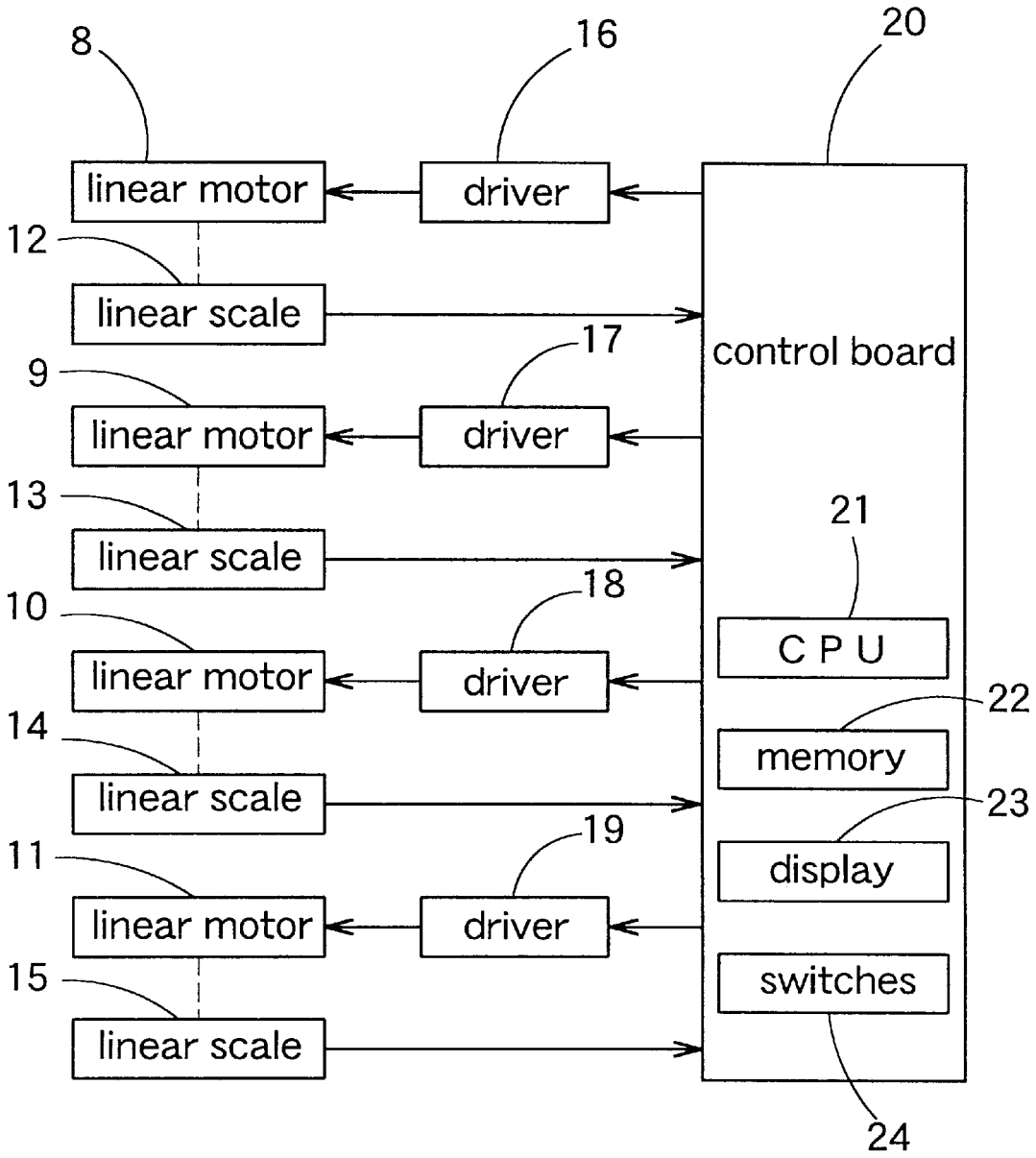
FIG. 4 is a block diagram of an electric system of a linear motor press.

FIG. 4 shows a control board (control circuit) 20 of a linear motor press and connection state of a linear motor or the like connected there.

The control circuit 20 is constituted by a CPU 21 being the essential part, and controls operation of the press based on program data previously stored in a fixed memory. The control circuit 20 is provided with a temporary memory 22 which can be read and written at any time, a display 23, and switches 24 for inputting or operating various sorts of set values. In the memory 22, a memory area is provided for storing press operation pattern program data previously registered, stroke length, SPM value (number of stroke per minute), die height set value, press set times or the like set and inputted. Set stroke length, SPM value, die height set value, press set times or the like are displayed on the display 23 for displaying the set screen.

The linear scales 12–15 as above described are connected to an interface circuit within the control circuit 20, and sends reading of each of the linear scales 12–15, i.e., the position detection data (real position data) of the slide 4 to the control circuit 20. Drivers 16–19 are connected respectively to the four linear motors 8–11, and are connected also to the interface circuit within the control circuit 20. During the operation, in the linear motors 8–11, for example, that of AC servo motor (three-phase synchronous motor) system having large thrust is used, and the drivers 16–19 have a servo amplifier for example and drive the linear motors 8–11 in response to the command value outputted from the control circuit 20.

Figure 5:
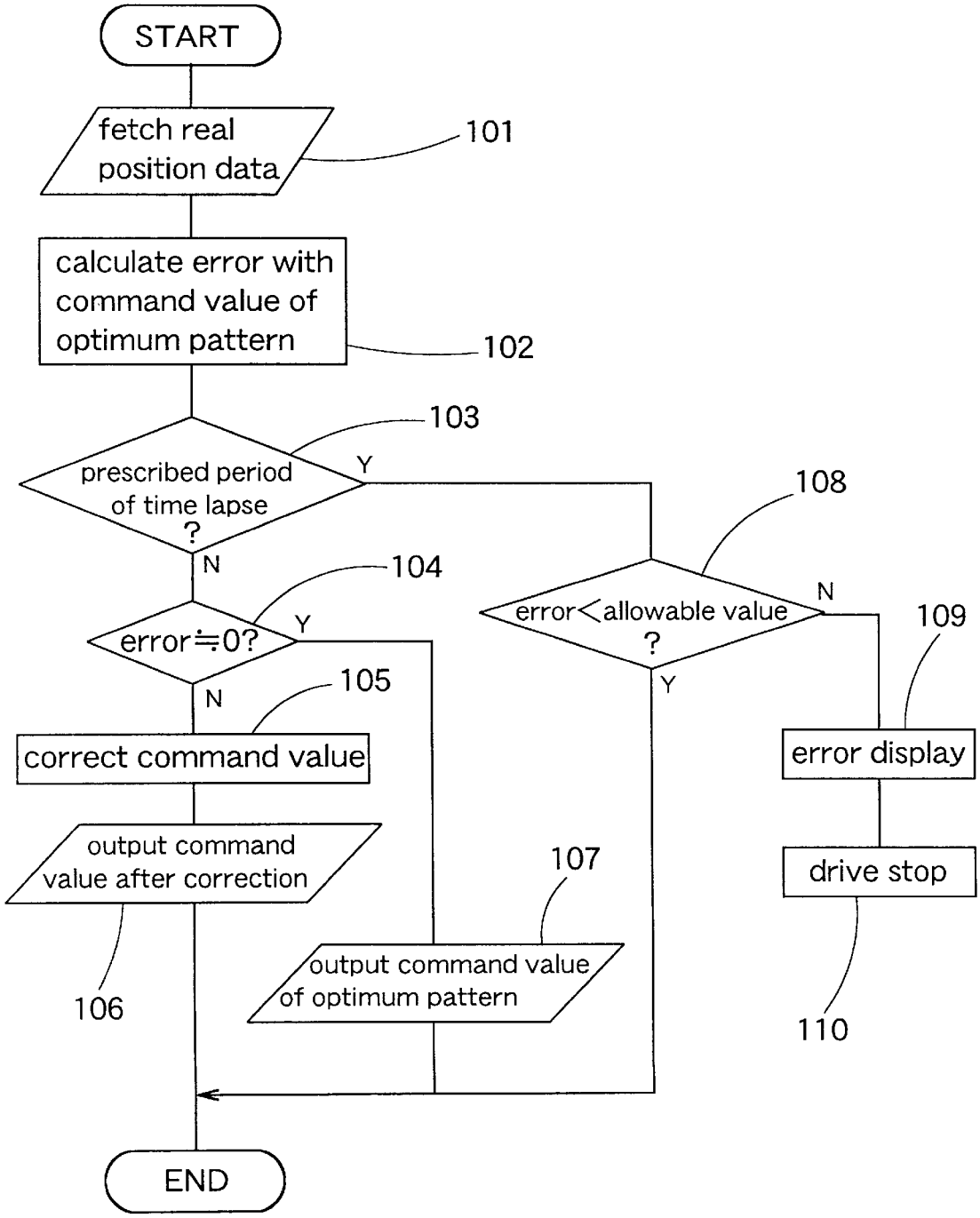
FIG. 5 is a flow chart showing processing content of a control circuit.

Next, the processing according to the present invention executed in the above-mentioned control circuit 20 will be described based on a flow chart shown in FIG. 5.

When the slide 4 starts the driving, the control circuit 20 fetches the real position data from the linear scales 12–15 (step 101).

Next, from the optimum pattern of behavior of the slide 4 fixed and stored previously, a command value to be subsequently outputted is read out and error between the fixed command value of the optimum pattern and the real position data is calculated (step 102).

Next, decision is effected regarding whether or not a prescribed period of time lapses from the drive start of the slide 4 (step 103). Here, the prescribed period of time is set to the time until the actual behavior of the slide 4 converged to the optimum pattern by the execution of the learning control.

Immediately after the drive start of the slide 4, the decision result in the step 103 becomes "YES" and next decision is effected regarding whether or not it is without error (step 104).

Figure 6:
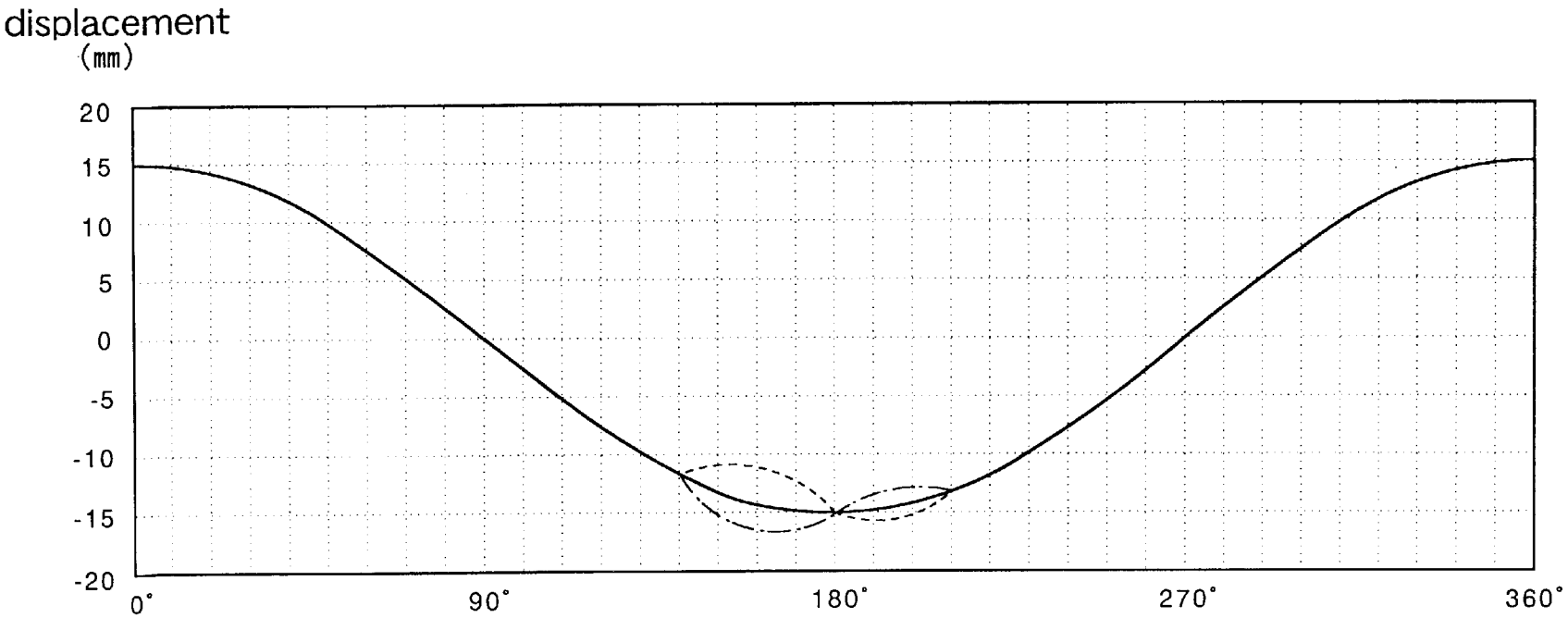
FIG. 6 is a behavior pattern diagram of a slide.

If the decision is effected that it is with error, in order to eliminate the error, the error component is added to the fixed command value of the optimum pattern and the command value to be outputted is corrected (step 105), and the command value after the correction is outputted to the drivers 16–19 (step 106). For example, on the contrary to the optimum pattern of the behavior of the slide 4 during the punching machining shown by solid line in FIG. 6, when the actual behavior pattern of the slide 4 becomes that having deflection or overshoot as shown by broken line in FIG. 6, the command value corresponding to the pattern after the correction shown by dash-and-dot line in FIG. 6 is outputted from the control circuit 20.

Such correction of the command value to be outputted is performed repeatedly. As a result, the behavior of the pattern approaches the optimum pattern. When the behavior of the slide 4 is coincident with the optimum pattern, since the error is eliminated, the decision result in the step 104 is reversed to "YES", and the fixed command value of the optimum pattern is outputted as the output command value (step 107).

And then, after lapse of the prescribed period of time from the drive start of the slide 4, the decision result in the step 103 is reversed to "YES", and decision is effected regarding whether or not the error exceeds the allowable value (step 108). Here, the allowable value is set based on the machining error, for example, error produced due to generation of breakage of a metal mold, rise of shavings, life of the metal mold, twice punching or the like.

When the decision is effected that the error exceeds the allowable value, the actual behavior pattern based on the real position data is compared with the behavior pattern in each error previously fixed and stored in each error, and sort of the error corresponding to the coincident behavior pattern is displayed on the display 23 (step 109), and the linear motors 8–11 are stopped in driving (step 110).

Also the control circuit 20 stores the result of the learning control, in other words, the command value after the correction or the error. The stored command value after the correction or the error can be utilized in the slide control of another linear motor press operating the slide by the same optimum pattern as the optimum pattern of the behavior of the slide of the linear motor press. In this case, as described later, this is particularly effective in the slide control of a linear motor press not having a linear scale (temporarily called a usual linear motor press).

Figure 7:
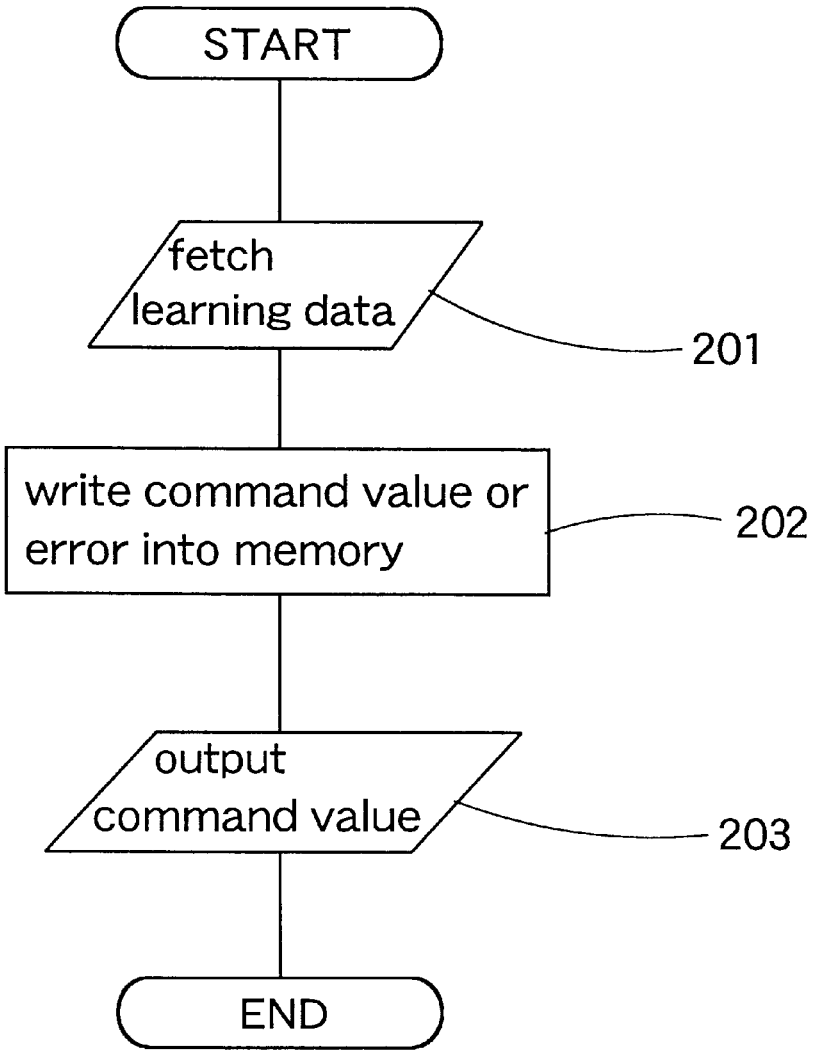
FIG. 7 is a flow chart explaining processing content of a slide control device of a linear motor press not having a linear scale.

FIG. 7 is a flow chart showing processing content of a slide control device of a usual linear motor press, that is, a slide control device of a usual linear motor press constituted by the linear motor press itself with a linear scale shown in FIG. 1 excluding the linear scale, or a slide control device of a linear motor press of the same sort as that of the linear motor press with a linear scale shown in FIG. 1 and not having a linear scale.

The slide control device of the usual linear motor press controls the behavior of the slide so as to be coincident with the optimum pattern even if a linear scale is not installed, by utilizing the learning result obtained by the slide control device of the linear motor press with the linear scale as above described, that is, the command value after the correction or the error within the prescribed period of time.

That is, as shown in FIG. 7, the slide control device of the usual linear motor press fetches the learning data being the result of the learning control using the slide control device of the linear motor press with the linear scale as above described from the memory of the slide control device of the linear motor press with the linear scale to the control device (step 201), and writes the command value or the error of the learning data into the memory (step 202). And then, when the slide is operated, the command value or the error is read out from the memory, and the read-out command value or the command value calculated from the read-out error is outputted (step 203).

Figure 8:
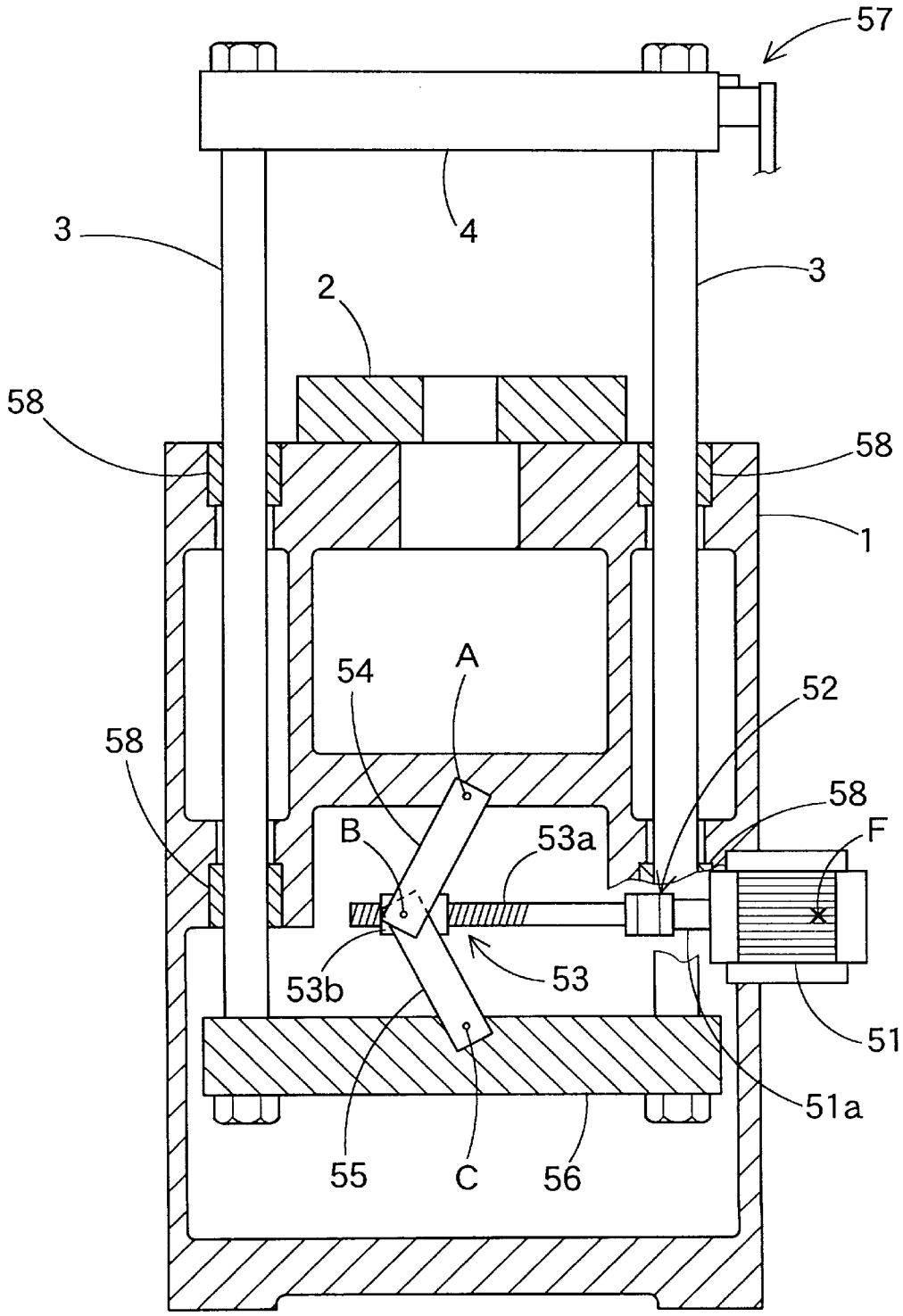
FIG. 8 is a schematic constitution diagram of a servo motor press to which a slide control device according to another embodiment of the invention is applied.

FIG. 8 is a schematic constitution diagram of a servo motor press in place of a conventional link press.

In FIG. 8, a servo motor 51 is arranged so that the axial line of an output shaft 51*a* is slightly rockable on the vertical surface with respect to the point F as the rocking center to the body frame 1. A male screw part 53*a* of a ball screw 53 is connected to the output shaft 51*a* of the servo motor 51 through a coupling 52. One end of a first lever 54 is pin-coupled with the body frame 1, and other end thereof is pin-coupled with a female screw part 53*b* of the ball screw 53. One end of a second lever 55 is pin-coupled with a coupling member 56 fixed to each guide post 3, and other end of the second lever 55 is pin-coupled also with the female screw part 53*b*.

The forward and reverse rotational motion of the servo motor 51 is converted into the linear reciprocation motion of the female screw part 53*b* through the coupling 52 and the male screw part 53*a*. Since the first lever 54 is connected to the female screw part 53*b*, and attendant on the motion of the female screw part 53*b*, the first lever 54 rocks with respect to the point A as the rocking center, the linear reciprocation motion of the female screw part 53*b* can be strictly said the rocking motion with respect to the point A as the rocking center. Due to the rocking motion of the female screw part 53*b*, the point C of the second lever 55 is moved in reciprocation up and down, and the slide 4 is moved up and down through the coupling member 56 and the guide post 3.

Also in order to detect the real position in upward and downward direction of the slide 4, a linear scale 57 having similar constitution to that of the linear scales 12–15 as above described is arranged between the body frame 1 and the slide 4. In addition, numeral 2 designates a bolster, and numeral 58 designates a thrust bearing.

In the servo motor press, when the servo motor 51 is rotated alternately forward and reversely, as above described, the slide 4 is moved in reciprocation up and down through the coupling 52, the ball screw 53, the second lever 55, the coupling member 56 and the guide post 3. The real position of the slide 4 is detected by the linear scale 57, and the detection signal is inputted to a control circuit (not shown).

In the control circuit (not shown), similar processing (FIG. 5) to that of the control circuit 20 as shown in FIG. 4 as above described is executed. That is, the control circuit ① fixes and stores previously the optimum pattern command value of the behavior of the slide 4, and calculates error between the real position data from the position detector (linear scale 57) and the fixed command value of the optimum pattern in a prescribed period of time from the drive start of the slide, and corrects the command value to be outputted in order to eliminate the error, and outputs the command value after the correction and controls the servo motor 51, and ② stops the servo motor after lapse of the prescribed period of time if the error between the real position data and the fixed command value of the optimum pattern exceeds the allowable value based on the machining error, and ③ stores the command value after the correction or the error within the prescribed period of time.

Also in a slide control device of a servo motor press not having a linear scale (temporarily called a usual servo motor press), that is, a usual servo motor press constituted by the servo motor press itself with the linear scale as shown in FIG. 8 excluding the linear scale, or a usual servo motor press constituted by a servo motor press of the same sort as that of the servo motor press with the linear scale as shown in FIG. 8 and not having a linear scale, utilizing the learning result obtained by the slide control device of the servo motor press with the linear scale as above described, i.e., the command value after the correction or the error within the prescribed period of time, even if a linear scale is not installed, the behavior of the slide can be made coincident with the optimum pattern.

In addition, the servo motor press is not limited to that shown in FIG. 8 where a servo motor is used as a power source of a conventional link press, but can be applied also to a press of crank type or cam type.

According to the present invention, the learning control is adopted in the slide control of the linear motor press or the servo motor press, and the actual behavior pattern of the slide is converged to the optimum pattern thereby breakage of a metal mold or the like can be prevented. Further after the learning control, generation of the machining error is detected and the linear motor or the servo motor is stopped in driving thereby the improvement of the yield, prevention of breakage of a metal mold or the like can be intended.

Also according to the present invention, the result of the learning control is stored thereby the control result can be utilized in the slide control of another usual linear motor press or a usual servo motor press.

What is claimed is:

1. A slide control device of a press, comprising:

a motor for driving a slide in reciprocation;

a position detector for detecting position of said slide; and a control circuit for fixing and storing previously the optimum pattern command value of behavior of said slide, for calculating error between the real position data from said position detector and the fixed command value of the optimum pattern in a prescribed period of time from the drive start of the slide, for correcting the command value to be outputted in order to eliminate the error, and for outputting the command value after the correction and controlling said motor.

2. A slide control device of a press as set forth in claim 1, wherein said control circuit stops said motor, after lapse of the prescribed period of time, if the error between the real position data and the fixed command value of the optimum pattern exceeds the allowable value based on the machining error.

3. A slide control device of a press as set forth in claim 1 or claim 2, wherein said control circuit stores the command value after the correction or the error within the prescribed period of time.

4. A slide control device of a press as set forth in claim 1 or claim 2, wherein said motor is a linear motor.

5. A slide control device of a press as set forth in claim 1 or claim 2, wherein said motor is a servo motor.

6. A slide control device of a press, comprising:

a linear motor for driving a slide in reciprocation;

a position detector for detecting position of said slide; and a control circuit for fixing and storing previously the optimum pattern command value of behavior of said slide, for calculating error between the real position data from said position detector and the fixed command value of the optimum pattern in a prescribed period of time from the drive start of the slide, for correcting the command value to be outputted in order to eliminate the error, and for outputting the command value after the correction and controlling said linear motor, characterized in that said control circuit stops said linear motor, after lapse of the prescribed period of time, if the error between the real position data and the fixed command value of the optimum pattern exceeds the allowable value based on the machining error, and stores the command value after the correction or the error within the prescribed period of time.

7. A slide control device of a press, comprising:

a servo motor for driving a slide in reciprocation;

a position detector for detecting position of said slide; and a control circuit for fixing and storing previously the optimum pattern command value of behavior of said slide, for calculating error between the real position data from said position detector and the fixed command value of the optimum pattern in a prescribed period of time from the drive start of the slide, for correcting the command value to be outputted in order to eliminate the error, and for outputting the command value after the correction and controlling said servo motor, characterized in that said control circuit stops said servo motor, after lapse of the prescribed period of time, if the error between the real position data and the fixed command value of the optimum pattern exceeds the allowable value based on the machining error, and stores the command value after the correction or the error within the prescribed period of time.

8. A slide control device of a press comprising a motor for driving a slide in reciprocation, and a control circuit for controlling said motor, wherein in a control device of a press constituted by mounting a position detector for detecting position of a slide to the press itself or a press of the same sort as that of the press, said control circuit fixes and stores previously the optimum pattern command value of behavior of the slide, and calculates error between the real position data from said position detector and the fixed command value of the optimum pattern in a prescribed period of time from the drive start of the slide, and corrects the command value to be outputted in order to eliminate the error and outputs the command value after the correction and controls said motor, characterized in that said motor is controlled based on the command value after the correction or the error within the prescribed period of time, obtained by the control device having the control circuit.

9. A slide control device of a press as set forth in claim 8, wherein said motor is a linear motor.

10. A slide control device of a press as set forth in claim 8, wherein said motor is a servo motor.

* * * * *